United States Patent [19]

Anderson et al.

[11] 3,963,081

[45] June 15, 1976

[54] DOUBLE ACTING MECHANICAL JAR

[76] Inventors: Edwin A. Anderson, 1104 Chimney Rock Road, Houston, Tex. 77027; Derrel D. Webb, 802 Axilda, Houston, Tex. 77017

[22] Filed: Apr. 24, 1975

[21] Appl. No.: 571,093

[52] U.S. Cl. ..... 175/304

[51] Int. Cl.[2] ..... E21B 1/10

[58] Field of Search ..... 175/299, 302, 303, 304, 175/294

[56] References Cited

UNITED STATES PATENTS

| | | | |
|---|---|---|---|
| 2,013,127 | 9/1935 | Bowen | 175/303 |
| 2,059,540 | 11/1936 | Stephan | 175/302 |
| 2,978,048 | 4/1961 | Walker | 175/294 |
| 3,050,131 | 8/1962 | Siracusa et al. | 175/294 |
| 3,208,541 | 9/1965 | Lawrence | 175/299 |
| 3,685,598 | 8/1972 | Nutter | 175/304 |
| 3,685,599 | 8/1972 | Kisling III | 175/302 |
| 3,880,249 | 4/1975 | Anderson | 175/302 |

*Primary Examiner*—James A. Leppink
*Attorney, Agent, or Firm*—Jack W. Hayden

[57] ABSTRACT

A double acting mechanical jar includes an outer housing and a mandrel extending longitudinally thereof with means connecting the mandrel and housing for relative longitudinal movement therebetween while inhibiting relative rotation therebetween. First and second one-way acting sleeve collet means are carried in longitudinal spaced relation by the housing and first and second boss collet means are mounted on the mandrel and the first and second one-way acting sleeve collet means and the first and second boss collet means each include a plurality of annular ridges thereon with the annular ridges on the sleeve and boss collet means being arranged in unequal, longitudinal spaced increments relative to the other annular ridges on each the sleeve and boss collet means respectively so that as the boss collet is moved into engagement with the one-way acting sleeve means only one of the annular ridges on the sleeve and boss collet means engages and thereafter disengages as the boss collet is moved into engagement with the one-way acting sleeve means until the boss collet means and one-way acting sleeve means are fully engaged whereupon each of the annular ridges on said sleeve and boss collet means are engaged.

19 Claims, 12 Drawing Figures

DOUBLE ACTING MECHANICAL JAR

CROSS REFERENCE TO RELATED APPLICATION

The present invention is an improvement over the invention described in U.S. Pat. No. 3,880,249, which patent is copending with this application.

SUMMARY OF THE INVENTION

The prior art with which applicant is familiar is as follows: U.S. Pat. Nos. 2,013,127; 2,059,540; 2,891,772; 3,050,131; 3,208,541; 3,233,690; 3,685,598; and 3,685,599.

The invention of copending application Ser. No. 450,368, now U.S. Letters Pat. No. 3,880,249 discloses a double acting jar for a well string wherein the jar may be positioned in the well string during drilling operations so that either an upward jar or impact or a downward jar or impact may be selectively applied to the well string as desired. In employing a construction as disclosed in said U.S. Pat. No. 3,880,249 it is desirable that the coupling means on the housing and the coupling engaging means on the mandrel be fully engaged at the predetermined load or force at which it is desired to apply an impact or jar to the well string before such coupling means and coupling engaging means are forceably disengaged to apply such jar to the well string.

In addition, in some instances it may be desirable to provide a double acting jar which does not have a substantial amount of free travel between the upward jarring position and the downward jarring position. Accordingly, an object of the present invention is to provide an improved form of coupling means and coupling engaging means in a double acting mechanical jar which are fully engagable upon nonrotational movement of a mandrel relative to a housing before such coupling means and coupling engaging means are forceably disengaged to selectively apply either an upward or a downward jar or impact to the well string.

Yet a further object of the present invention is to provide a double acting jar for a well string which includes a coupling means on a housing and a coupling engaging means on a mandrel extending longitudinally of the housing which coupling means and coupling engaging means may be fully engaged upon nonrotational movement of the mandrel relative to the housing to apply a predetermined force to the mandrel before the coupling and coupling engaging means disengage to selectively apply either an upward or downward jar to the well string.

Yet a further object of the present invention is to provide an improved form of coupling means and coupling engaging means in a double acting jar which are fully engagable upon nonrotational movement of a mandrel relative to a housing before such coupling means and coupling engaging means are forceably disengaged to selectively apply either an upward or a downward jar or impact to the well string.

Yet a further object of the present invention is to provide an improved form of coupling means and coupling engaging means in a double acting jar which are fully engagable upon nonrotational movement of a mandrel relative to a housing before such coupling means and coupling engaging means are forceably disengaged to selectively apply either an upward or a downward jar or impact to the well string and wherein the amount of travel of the mandrel relative to the housing between the upward jarring position and downward jarring position is maintained at a minimum.

Yet a further object of the invention is to provide a double acting jar to be carried in a well string during drilling operations for delivering either an upward or downward jar to the well string and which includes a first and second one-way acting sleeve collet means carried on a housing and a first and second boss collet means mounted on a mandrel with means for accommodating longitudinal but nonrotatable movement of the mandrel relative to the housing and seal means for sealing off between the mandrel and the housing to seal off the first and second one-way acting sleeve collet means and the first and second boss collet means from well fluid exterior of the housing.

Yet a further object of the invention is to provide a double acting jar to be carried in a well string during drilling operations for delivering either an upward or downward jar to the well string and which includes a first and second one-way acting sleeve collet means carried on a housing and a first and second boss collet means mounted on a mandrel with means for accommodating longitudinal but nonrotatable movement of the mandrel relative to the housing and seal means for sealing off between the mandrel and the housing to seal off the first and second one-way acting sleeve collet means and the first and second boss collet means from well fluid exterior of the housing and additional means sealably arranged between the mandrel and the housing to compensate for pressure differentials between the interior and the exterior of the housing.

Yet a further object of the invention is to provide a double acting jar to be carried in a well string during drilling operations for delivering either an upward or downward jar to the well string and which includes a first and second one-way acting sleeve collet means carried on a housing and a first and second boss collet means mounted on a mandrel with connecting means for accommodating longitudinal but nonrotatable movement of the mandrel relative to the housing and seal means for sealing off between the mandrel and the housing to seal off the first and second one-way acting sleeve collet means and the first and second boss collet means from well fluid exterior of the housing and additional means for sealing off the connecting means between the mandrel and the housing from well fluid exteriorly of the housing.

Yet a further object of the invention is to provide a double acting jar to be carried in a well string during drilling operations for delivering either an upward or downward jar to the well string and which includes a first and second one-way acting sleeve collet means carried on a housing and a first and second boss collet means mounted on a mandrel with connecting means for accommodating longitudinal but nonrotatable movement of the mandrel relative to the housing and seal means for sealing off between the mandrel and the housing to seal off the first and second one-way acting sleeve collet means and the first and second boss collet means from well fluid exterior of the housing and additional means for sealing off the connecting means between the mandrel and the housing from well fluid exteriorly of the housing and said seal means including means for accommodating any changes in volume between the mandrel and the housing as the mandrel is moved longitudinally relative to the housing.

Still an additional object of the present invention is to provide in a double acting mechanical jar having an outer housing in which a mandrel is longitudinally but nonrotatably moveable for selectively either an upward or a downward jar to a well string in which the double acting jar is carried during the drilling operations, means to enable the jar to be loaded to a predetermined amount before the mandrel is released relative to the housing for imparting a jar thereto.

Still an additional object of the present invention is to provide in a double acting mechanical jar having an outer housing in which a mandrel is longitudinally but nonrotatably moveable for selectively delivering either an upward or a downward jar to a well string in which the double acting jar is carried during the drilling operations, means to enable the jar to be loaded to a predetermined amount before the mandrel is released relative to the housing for imparting a jar thereto, said means including spaced one-way acting sleeve collet means carried in said housing and spaced first and second boss collet means mounted on the mandrel with said first and second sleeve and boss collet means each including a plurality of annular ridges arranged in unequal longitudinally spaced increments whereby as said mandrel is moved longitudinally of said housing to engage a boss collet means with a sleeve collet means, only one of the annular ridges on the boss collet means will contact one annular ridge on the sleeve means until the boss collet means is fully engaged with the sleeve means whereupon all of the annular ridges of the boss collet means and the sleeve means are engaged so that subsequent movement of the mandrel will thereafter force disengagement of the boss collet means with the sleeve means to impart a jar selectively in either an upward or downward direction to the well string depending upon the direction of movement of the mandrel relative to the housing.

Still an additional object of the present invention is to provide in a double acting mechanical jar having an outer housing in which a mandrel is longitudinally but nonrotatably moveable for selectively delivering either an upward or a downward jar to a well string in which the double acting jar is carried during the drilling operations, means to enable the jar to be loaded to a predetermined amount before the mandrel is released relative to the housing for imparting a jar thereto, said means including spaced one-way acting sleeve collet means carried in said housing and spaced first and second boss collet means mounted on the mandrel with said first and second sleeve and boss collet means each including a plurality of annular ridges arranged in unequal longitudinally spaced increments whereby as said mandrel is moved longitudinally of said housing to engage a boss collet means with a sleeve collet means, only one of the annular ridges on the boss collet means will contact one annular ridge on the sleeve means until the boss collet means is fully engaged with the sleeve means whereupon all of the annular ridges of the boss collet means and the sleeve means are engaged so that subsequent movement of the mandrel will thereafter force disengagement of the boss collet means with the sleeve means to impart a jar selectively in either an upward or downward direction to the well string depending upon the direction of movement of the mandrel relative to the housing; therebeing means for securing the mandrel and housing to accommodate longitudinal but non-rotatable movement of the mandrel relative to the housing and seal means for forming a fluid receiving chamber between the mandrel and the housing to seal off the connecting means between the mandrel and the housing and the one-way acting sleeve and boss collet means.

DESCRIPTION OF THE PREFERRED EMBODIMENT

Figure 1A:
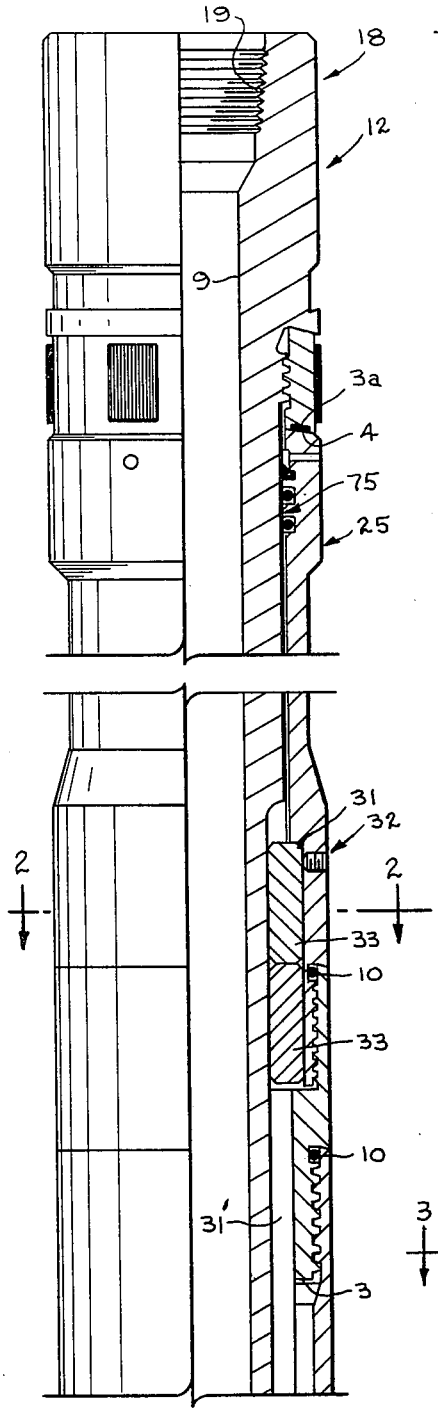
FIGS. 1A – 1D are longitudinal quarter sectional views of a preferred embodiment of the present invention.
Figure 1B:
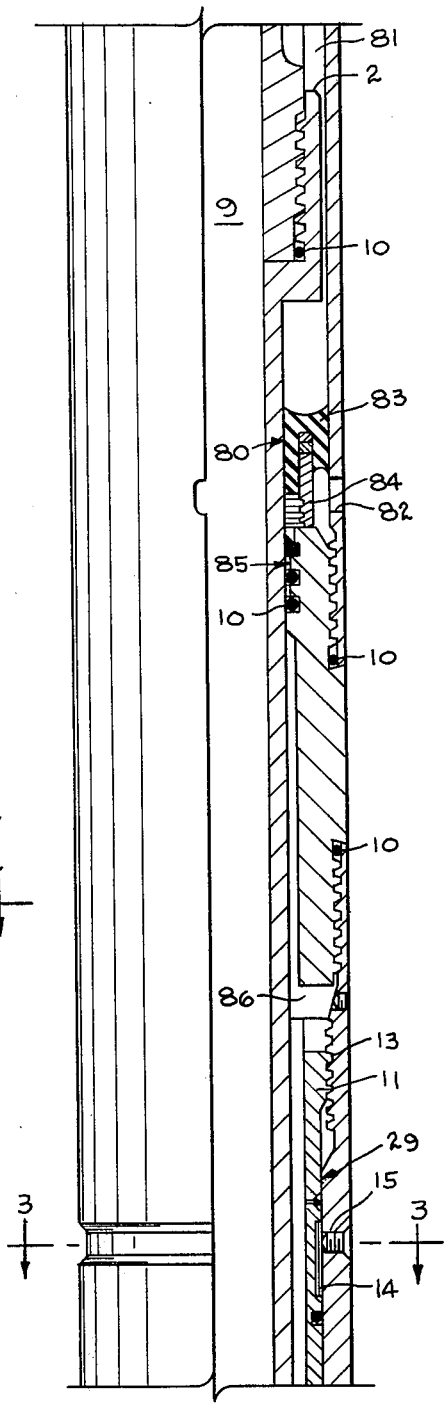

Attention is first directed to FIGS. 1A–1B of the drawings wherein the form of the present invention is referred to generally by the numeral 12. A mandrel referred to at 18 is provided with suitable means such as threads 19 for connection with a well string which extends upwardly therefrom and to the earth's surface. The mandrel extends longitudinally within the housing referred to generally at 25 and the housing 25 includes suitable means at its lower end such as the threads referred to generally at 30 so that the housing 25 may be connected into a portion of the well string extending downwardly therefrom in the well bore.

In FIG. 1A means referred to generally at 32 are provided for connecting the mandrel 18 and outer housing 25 together to accommodate relative longitudinal movement therebetween while inhibiting relative rotation therebetween.

Figure 1C:
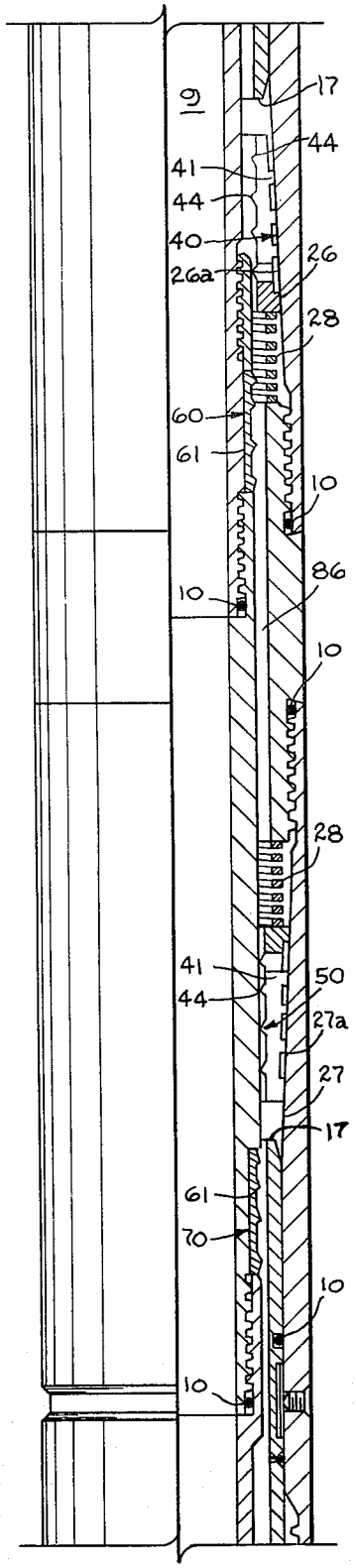

First and second one-way acting coupling means referred to generally at 40 and 50 are carried by the housing 25 in spaced longitudinal relationship as illustrated in FIG. 1C.

Spaced coupling engaging means referred to generally at 60 and 70 in FIG. 1C are mounted on the mandrel 18 for selective engagement with the one-way acting coupling means 40 and 50 respectively, for imparting a jar to the well string selectively in either an upward or downward direction as will be described in greater detail hereinafter.

The mandrel 18 is provided with a longitudinally extending bore 9 for circulation of drilling fluids through the well string in which the jar 12 of the present invention is connected.

It will be noted that the housing and the mandrel are formed by a plurality of tubular bodies as shown in FIGS. 1A through 1D which are threadedly connected together and are provided with seals such as illustrated at 10 for inhibiting leakage of fluid from exteriorly of the housing 25 into the space between the mandrel 18 and housing 25, or from the longitudinal bore 9.

Seal means referred to generally at 75 and 80 spaced on each side of the connecting means 32 as shown in FIGS. 1A and 1B define an upper fluid receiving chamber 81 for providing lubrication to the connecting means 32. It can be appreciated that as the mandrel 18 is moved longitudinally relative to the housing 25, the volume of chamber 81 will change.

For example, as shown in FIGS. 1A–1D inclusive the tool 12 is shown in its closed position with the mandrel 18 fully telescoped within the housing 25. However, as the mandrel 18 is moved upwardly relative to the housing 25, the volume of the chamber 81 will increase and the seal means 80 includes an arrangement for compensating for the changes in volume of the chamber 81 as relative movement of the mandrel 18 to the housing 25 occurs. It will be noted that a port 82 is provided in the housing 25 immediately beneath the seal means 80 as shown in FIG. 1B. The seal means 80 includes the annular elastomer member 83 which seals off between the housing 25 and mandrel 18 in the chamber 81 and is molded on the annular body 84. As changes in the volume of chamber 81 occur, fluid pressure in the well bore exterior of the housing 25 is conducted through the port 82 and the seal means 80 is in the form of a movable barrier in the lower end of the upper chamber 81 which is responsive to pressure in the well bore and pressure in the chamber 81 to move longitudinally of the chamber 81.

Spaced seal means 85 and 90 between the mandrel 18 and housing 25 and spaced from each end of the first and second coupling and coupling engaging means 40, 50, 60 and 70 respectively define a lower fluid receiving chamber 86 extending between the seals 85 and 90.

Figure 1D:
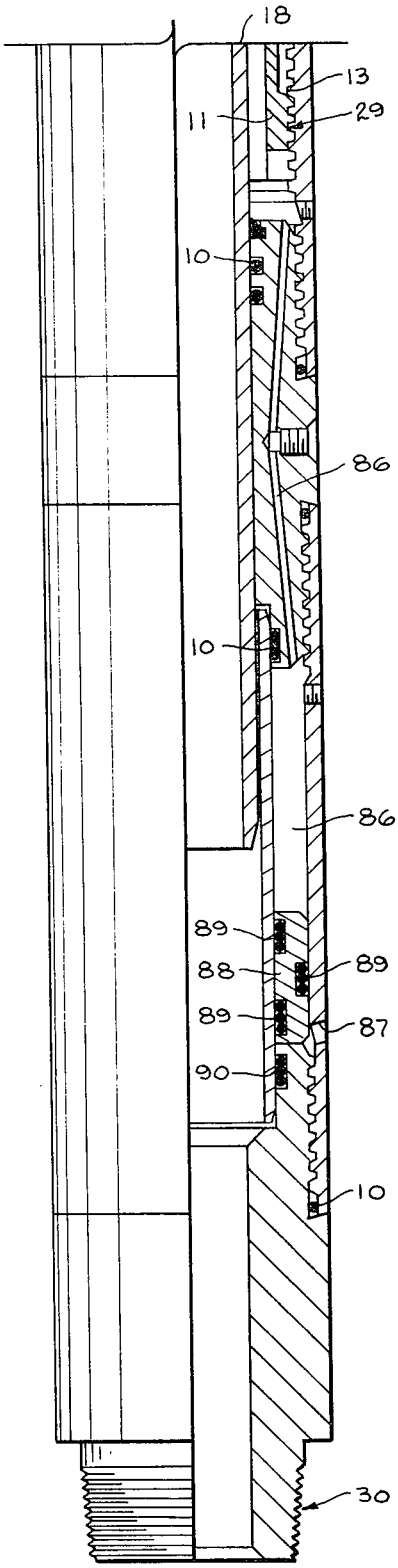

It can be appeciated that from the drawings the seals 85 and 90 are on the same size diameter of the mandrel 18 with which they sealingly engage, but when the tool is in a well bore, the pressure and temperature in the well bore will affect the fluid within the chamber 86. A port 87 is provided in the housing and a compensator or neutralizer 88 is mounted in the lower end of the fluid receiving chamber 86 as shown in FIG. 1D of the drawings. The fluid pressure acts on the neutralizer 88 which is an annular body and is provided with seals 89 for sealably engaging with the housing 25 and mandrel 18 so that as it moves in response to pressure variations in the well bore, contamination of the well bore fluid with fluids in the chamber 86 is inhibited.

Figure 2:
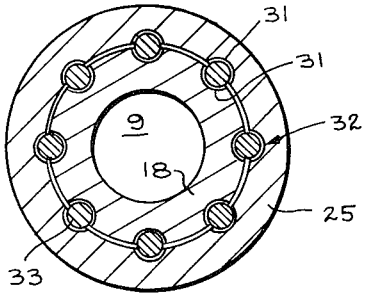
FIG. 2 is a sectional view on the line 2—2 of FIG. 1A illustrating a form of the connection means between the mandrel and the housing.

The connection means referred to generally at 32 in FIG. 1A is shown in greater detail in FIG. 2 and includes a plurality of circumferentially spaced and longitudinally extending grooves 31 on the housing 25 and mandrel 18 which are adapted to receive the annular members 33 therein as shown in FIG. 2. As previously noted the body 25 is formed of a plurality of tubular sections so that the annular bodies 33 may be positioned within the recesses formed by the grooves 31 between the body 25 and mandrel 18 as the tool is assembled. it will be noted that the semicircular grooves 31 in the body 25 extend approximately the length of the annular members 33 whereas the semicircular slots 31' in the mandrel 18 extend longitudinally of the mandrel a substantial extent as shown in FIG. 1A. Thus, the annular members 33 cooperate with the semicircular slots 31' in mandrel 18 to accommodate longitudinal, but nonrotational movement of the mandrel 18 relative to the housing 25.

The first and second one-way acting coupling means 40 and 50 comprises sleeve means or one-way acting sleeve collet means 41 better illustrated in FIGS. 4–8 of the drawings. The sleeve collet means 41 include a plurality of circumferentially spaced and longitudinally extending slots 42 with the slots 42 beginning at the ends of the sleeve collet means 41 but terminating in spaced relation to the other end as represented at 43. The sleeve collet means 41 includes a plurality of annular projections **42*b* which are separated by annular recesses 42*c*** on the outer periphery thereof.

In addition, the sleeve collet means 41, comprising the coupling means 40 and 50, each include a plurality of inwardly extending annular ridges 44 which extend inwardly of such sleeve as shown in FIGS. 4–8 inclusive with the ridges 44 being arranged in unequal, longitudinally spaced increments relative to each other as shown in FIGS. 4–8 of the drawings, and between the projections **42*b* as shown. This arrangement and configuration accommodates radial expansion and contraction of the sleeve collet means 41** as the coupling engaging means moves thereinto as will be described in greater detail hereinafter.

The coupling engaging means 60 and 70 each comprise an annular body 61 mounted on the mandrel 18 in longitudinally spaced relation as previously noted.

Each of the annular bodies 61 form what may be termed first and second boss collet means and each includes a plurality of annular ridges 62 on the outer surface thereof which are arranged in unequal longitudinally spaced increments relative to each other on the body 61 as shown in FIGS. 4 through 8 of the drawings.

The arrangement of the annular ridges 44 and 62 on the one-way acting sleeve means 41 and on the boss collet means 61 respectively enables the boss collet means 61 to become fully or completely engaged or telescoped within its respective one-way acting sleeve collet means 41 to obtain a predetermined force on the mandrel 18 so that when the boss collet means 61 is forceably disengaged from the one-way acting sleeve collet means 41 by moving it therethrough in the direction in which a jar is to be applied to the well string, the predetermined jar desired to be applied to the well string will be built up by the engagement between the boss collet means 61 and the adjustable one-way acting sleeve collet means 41 prior to disengagement therebetween for delivering a jar to the well string.

It will be further noted that the first and second coupling means comprising the one-way acting sleeve collet means 41 are each received on an annular taper **26*a* and 27*a* forming the bowls 26 and 27 in the housing 25. It will be noted that the taper 26 extends longitudinally downwardly as the tool is viewed in FIG. 1C of the drawings whereas the annular taper 27 extends upwardly relative to the longitudinal axis of the mandrel and housing. Suitable spring means 28 are carried by the housing 25 and one end thereof abuts each of the longitudinally spaced one-way acting sleeve means 41** as shown in FIG. 1C of the drawings. Adjusting means referred to generally at 29 in FIGS. 1*b*, 1*d*, and 3 are provided for each of the spaced one-way acting sleeve collet means to adjust their position on the tapered bowls 26 and 27 and thus predetermine the force necessary to be applied to the mandrel 18 to forceably move the boss collet thereon through one of the one-way acting sleeve collet means to impart a jar in either an upward or downward direction to the well string in which the tool is connected.

Figure 3:
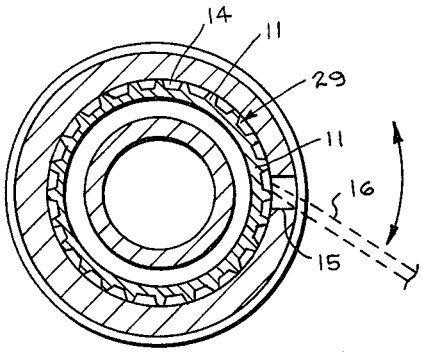
FIG. 3 is a sectional view on the line 3—3 of FIG. 1B illustrating in greater detail the form of adjustment means for the present invention.
Figure 6:
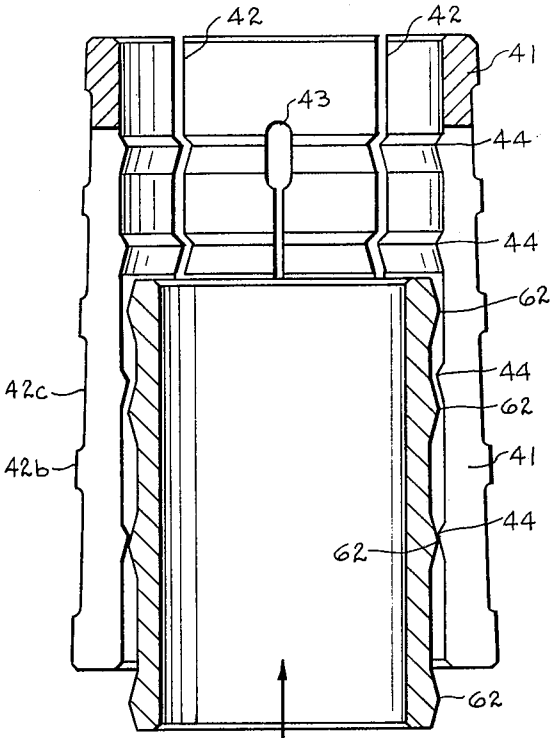
FIG. 6 illustrates another relative position of the annular body as it is moved into telescoping relationship with the sleeve on the housing.

The adjusting means referred to generally at 29 is shown in greater detail in FIG. 3 and includes an annular member 11 which is threadedly connected to the housing as shown at 13. The member 11 may be provided with a plurality of longitudinally extending circumferentially spaced grooves 14 as shown in FIGS. 1B and 3 of the drawings. An access opening 15 is provided in the housing 25 for access to the member 11 by suitable means indicated in dotted line at 16 to engage in the recesses 14 for rotation of the annular member 11. This causes the annular member 11 to move longitudinally of the housing 25 and the sleeve means 41 are each abutted against one end 17 by means of the springs 28, so that the sleeve collet means 41 may be positioned longitudinally along the annular tapered bowls 26 and 27 respectively. However, the drawings illustrate the sleeve collet means 41 as being retracted relative to the ends 17 of each of the members 11. Thus, the position of the collet sleeves 41 on the annular tapers 26*a* and 27*a* will determine the amount of force or jar that may be applied to the well string since this changes the restriction between the first and second sleeve collet means 41 and their respective first and second boss collet means 60 and 70 and thus causes a greater or lesser gripping action between the boss collets 61 and their respective sleeve collet means 41 as the boss collet is pulled therethrough to forceably disengage the collet 61 and its respective sleeve collet 41 to impart a jar to the well string. As previously noted, it is desirable that the jar not prematurely release so that a predetermined jarring action may be applied to the well string in either an upward or a downward direction.

The arrangement of the annular ridges 44 on the sleeve collet means 41 and the annular ridges 62 on the boss collet or annular body 61 accomplishes this result. For example, by referring to FIG. 4, the arrow 66 represents the direction of movement of the mandrel 18 with respect to the housing 25 and one-way acting coupling means 40 comprising the sleeve means 41 when the uppermost coupling means 40 is to be engaged by the coupling engaging means 60 for forceably moving the boss collet means 61 into and through the upper collet sleeve means to impart an upward jar to the stuck well string in which the present invention is connected.

Figure 5:
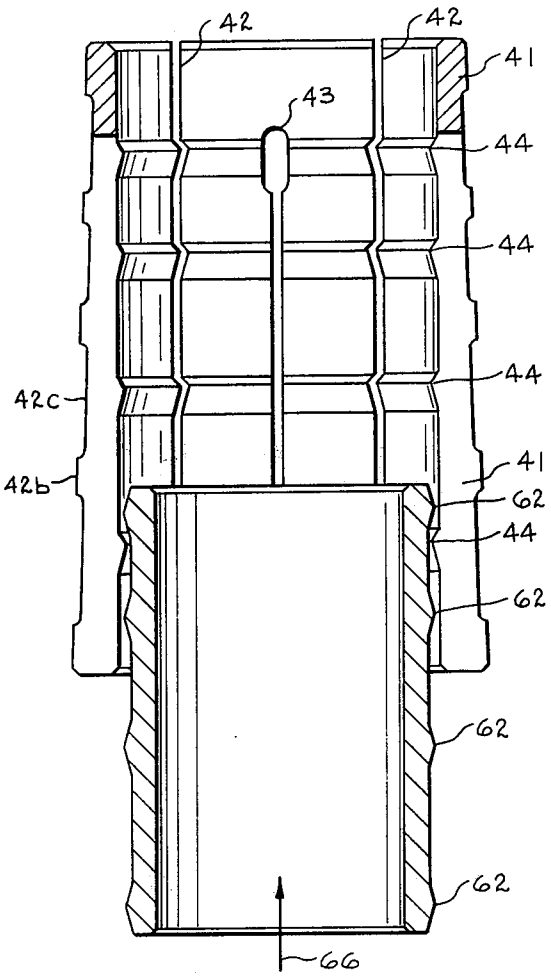
FIG. 5 diagrammatically represents the first position of the body within the sleeve as the mandrel and housing are moved longitudinally relative to each other and the relative position of the annular ridges on the body and sleeve.
Figure 4:
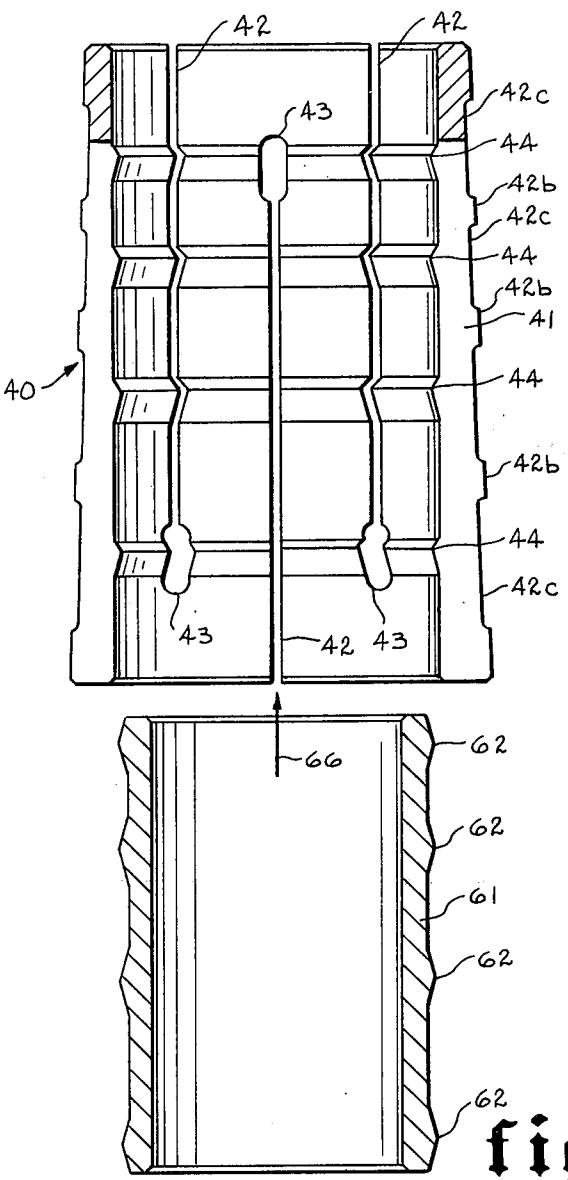
FIG. 4 is an enlarged sectional view of one of the sleeve means and one of the annular body means on the housing and mandrel respectively and showing an arrangement of annular ridges on each.

As the mandrel 18 is pulled upwardly relative to the housing 25, as represented by the arrow 66, the annular body 61 comprising the coupling engaging means 60 as shown in FIG. 1C moves into engagement or telescoping relation with the sleeve 41 as shown in FIG. 5.

It can be appreciated that if the distance between the annular ridges 44 on the first coupling means 40 and the distance between the annular ridges 62 on first coupling engaging means 60 were equally spaced, there would be an interference between the first and all subsequent annular ridges 44 and 62 on the sleeve collet means 41 and annular body means 61 respectively as the means 60 is moved into 40. However, since the annular ridges 44 are spaced an unequal distance longitudinally relative to each other and since the annular ridges 62 are spaced an unequal distance longitudinally relative to each other, the annular, circumferential ridges on the sleeve means 41 enable the coupling engaging means 60 to be stepwise engaged and the boss collet 61 gradually telescoped into sleeve collet means 41 without building up a force to the predetermined load at which the jar is to be applied to the well string until the body 61 has been completely telescoped within the sleeve 41.

Figure 7:
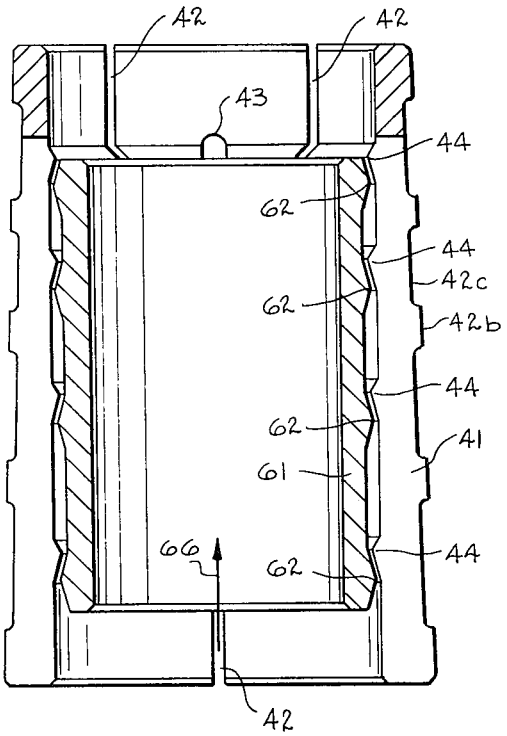
FIG. 7 shows diagrammatically and in sectional view the coupling means on the mandrel and the housing in fully engaged position immediately prior to disengagement.

For example, as shown in FIG. 5, it will be noted that the uppermost annular ridge 62 on the annular body or boss collet 61 has moved over the lowermost annular ridge 44 on the sleeve collet means 41. The unequal spacing of the annular ridges 44 and 62 enable only one set of ridges 44 and 62 to sequentially engage at a time as is illustrated in the drawings until the annular body 61 is completely telescoped or received within the sleeve means 41. At this time, each annular ridge 44 of the sleeve means 41 is adjacent a cooperating adjacent annular ridge 62 on the annular body 61 as shown in FIG. 7.

As previously noted, the sleeve means 41 may be adjusted or positioned on tapers 26*a* and 27*a* in housing 25 so that a predetermined force on mandrel 18 is required to move the upper boss collet forceably upwardly through the upper collet sleeve means 41 to apply a predetermined upward jar or impact to the well string and to forceably move the mandrel 18 downwardly through the lower sleeve collet means to apply a predetermined downward jar to the well string. This predetermined jar or impact will be the amount of force necessary to disengage the annular body 61 from the sleeve 41 by forceably moving the mandrel 18 in the same direction in which it was initially moved to lockably engage the annular body 61 with the sleeve means 41.

Figure 8:
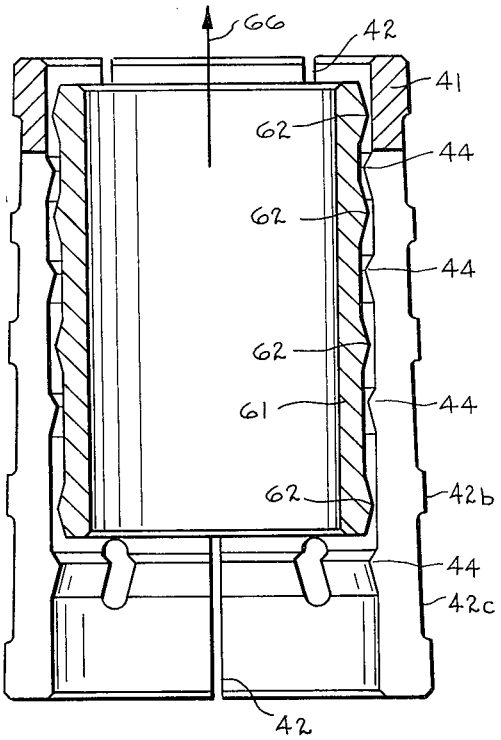
FIG. 8 is a sectional view and shows diagrammatically the relative position of the coupling means after the mandrel has continued its movement to move the coupling means on the mandrel through the coupling means on the housing to impart a jar to the well string.

This relationship is diagrammatically illustrated in FIG. 8 and shows the position of the annular body or upper boss collet 61 relative to the first sleeve collet 41 when it has been forceably moved therethrough to apply a jar or impact to the well string. It can be appreciated that when the annular body 61 and the outwardly projecting annular ridges 62 thereon are disengaged from the annular ridges 44 on sleeve means 41 and the annular ridges 44 thereon, such disengagement is sudden so that the shoulder 2 on the mandrel moves rapidly up to engage the shouler 3 on the housing 25 and strike a blow thereagainst to tend to urge or jar the housing 25 upwardly along with the well string in which it is connected.

Since the sleeve means 41 is one-way acting by reason of its arrangement on the tapered surfaces 26*a* and by reason of the longitudinally extending slots therein, the mandrel 18 may be moved in a direction reverse to that represented by the arrow 66 in FIGS. 4 through 8 so as to reposition the first coupling engaging means 60 beneath the coupling means 40 for reengagement therewith and for applying another upward jar to the tool as desired.

The operation of the second coupling means 50 and second coupling engaging means 70 is similar to that previously described with the exception that the mandrel is initially moved upwardly so that the coupling engaging means 70 comprising the sleeve 61 shown in FIG. 1C is moved freely through the coupling means 50 comprising the sleeve 41 and positioned thereabove. There is sufficient spacing between the upper coupling means 40 and lower coupling means 50 to accommodate movement of the mandrel 18 upwardly to enable the coupling means 50 to be freely pulled upwardly through the second engaging means 50 for thereafter moving the mandrel 18 down to lockably engage the means 50 and 70 in the manner as described above with respect to the means 40 and 60.

Thereafter the mandrel is lowered and force applied thereto so that the annular ridges on the body 61 stepwise engage each of the annular ridges 44 on the sleeve 41. When all of the annular ridges on 50 and 70 are engaged, the predetermined load necessary to accomplish this will be the downward jar that is to be applied to the well string and by continuing to move the mandrel 18 downwardly which is the direction in which it was initially moved to first engage the boss collet means 61 with the one-way acting sleeve means 41, disengagement therebetween is effected to impart a downward jar to the well string.

As the mandrel is thus intially positioned so that the coupling engaging means 70 is above the coupling means 50 shown in FIG. 1C so that the downward jar or impact may be applied to the well string as described, the shoulder 3*a* formed on the mandrel will be moved downwardly relative to the shoulder 4 on the housing, and when the coupling engaging means 70 and coupling means 50 suddenly disengage as the coupling engaging means is forceably moved through the coupling means 50, the mandrel will move downwardly rapidly so that shoulders 3*a* and 4 strike and thus impart a jar to the well string in a downward direction.

It can be appreciated that it may be desirable to provide metals of dissimilar nature between the coupling means 40, 50 and coupling engaging means 60 and 70 to inhibit galling or other undesirable characteristics. It can also be appreciated that the present invention provides a mechanical arrangement wherein an upward impact may be applied to a well string as many times as desired merely by resetting the mandrel 18 relative to the housing 25 so that the mandrel may thereafter be moved upwardly to engage the annular ridges on the sleeve 41 with the annular ridges 62 on the body 61 and to thereafter forceably disengage such ridges to cause a sudden upward impact to the well string.

Similarly a downward impact may be applied to the well string as many times as desired merely by positioning the coupling means 70 above the coupling means 50 and thereafter moving the annular body 60 comprising the coupling engaging means 70 into the sleeve means 41 comprising the second one-way acting sleeve means 50 until the annular ridges on each are engaged as previously described and thereafter forceably disengaging such annular ridges by continuing movement of the mandrel in the direction which effected engagement of the ridges.

In FIG. 9 the invention is again referred to generally by the numeral 12. The mandrel referred to generally at 18 is provided with threads 19 and the housing 25 is provided with threads 30 as previously described with regard to FIGS. 1A–1D. The connecting means 32 are provided for connecting the mandrel and housing to accommodate relative longitudinal movement between the mandrel and housing while inhibiting relative rotation therebetween as described with regard to FIGS. 1A–1D.

Spaced coupling engaging means referred to generally at 60 and 70 are mounted on the mandrel 18 for selective engagement with their respective one-way acting coupling means 40 and 50 for imparting a jar to the well string selectively in either an upward or downward direction in a manner as described with regard to the FIGS. 1A–1D form. Seal means 75 are of the form as illustrated in FIG. 1A and are arranged between the housing and the mandrel in spaced relation to the connecting means 32 and adjacent one end of the housing 25 as illustrated in FIG. 1A and FIG. 9.

Figure 9:
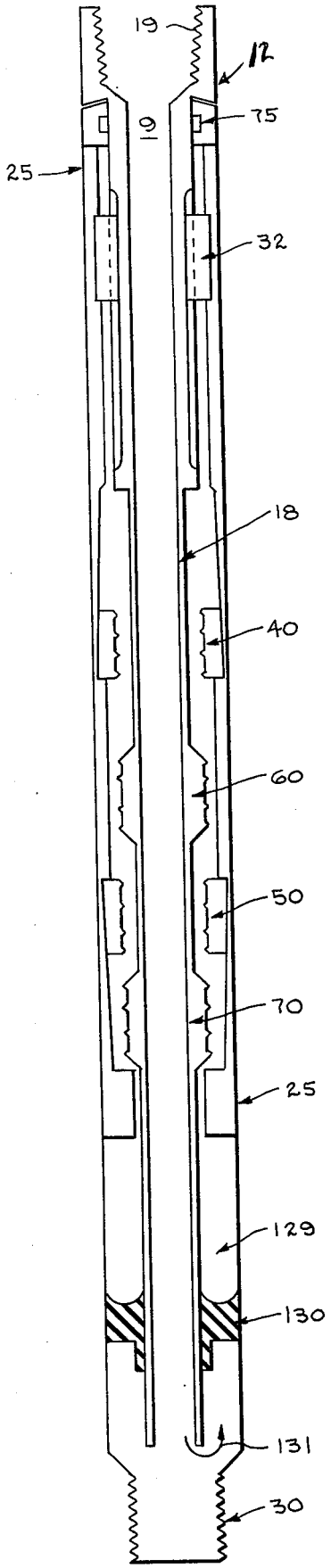
FIG. 9 illustrates an alternate preferred embodiment of the invention.

Seal means 130 in the form of an annular resilient ring are arranged between the housing 25 and mandrel 18 adjacent the lower end of the housing as schematically illustrated in FIG. 9 of the drawings.

The mandrel 18 is shown schematically as having a bore 9 extending longitudinally therethrough for circulating drilling fluids during normal drilling operations, or for circulating fluids during other well operations as may be desired.

In the form of the invention shown in FIG. 9, its construction and function is similar to that described with regard to FIGS. 1A-8 except it will be noted that there are no openings in the housing 25 for accommodating passage of well fluid from the well bore to act on any seal means within the housing 25 in a manner as described with regards to the FIGS. 1A–1D modification.

On the other hand, the fluid from the bore 9 of the mandrel 18 in the string in which the tool is connected will act on the seal 130 by passing around the lower end of the mandrel 18 as illustrated by the arrow 131. It can be appreciated that the space between the seal means 75 and seal means 130 forms a fluid receiving chamber between the housing 25 and mandrel 18 and seals off the connection 32 which accommodates longitudinal movement of the mandrel 18 while inhibiting rotation thereof relative to the housing 25 and also seals off the one-way acting coupling means 40 and 50 as well as the coupling engaging means 60 and 70. This arrangement inhibits any passage of fine sediment or other contaminant from the well bore into the interior of the tool and seals off the operating parts of the tool while accommodating changes in volume or pressure occurring in the fluid receiving chamber 129 formed between the seal means 75 and the seal means 30. The seal means 130 may be of any suitable type such as the seal means shown at 80 in FIG. 1*b* to form a movable barrier between the housing 25 and mandrel 18 and is responsive to the pressure in the well string in which the tool is connected to increase or decrease the size of the fluid receiving chamber 129.

It can be appreciated that the boss collet means 61 may be formed of a different material than the sleeve means 40 and 50, such as by way of example only, carbide or the like, to inhibit galling of the cooperating sleeve and boss collet means as the boss collet means is forced thereinto and therethrough to apply either an upward or a downward jar to the well string by means of the present invention as described herein.

The foregoing disclosure and description of the invention are illustrative and explanatory thereof, and various changes in the size, shape, and materials as well as in the details of the illustrated construction may be made without departing from the spirit of the invention.

What is claimed is:

1. A jar for a well string including:

a. an outer housing;

b. a mandrel extending longitudinally within said housing;

c. means connecting said mandrel and housing for relative longitudinal movement therebetween while inhibiting relative rotation therebetween;

d. first and second one-way acting sleeve collet means carried in longitudinal spaced relation in said housing;

e. first boss collet means mounted on said mandrel, said first boss collet means engageable with said first one-way acting sleeve collet means upon upward movement of said mandrel relative to said housing and disengagable from said first one-way acting sleeve collet means upon downward movement of said mandrel relative to said housing;

f. second boss collet means mounted on said mandrel in longitudinal spaced relation to said first boss collet means, said second boss collet means engagable with said second one-way acting sleeve collet means upon downward movement of said mandrel relative to said housing and disengagable from said second one-way acting sleeve collet means upon upward movement of said mandrel relative to said housing;

g. shoulder means on said housing and mandrel;

h. said first boss collet means and said first one-way acting collet sleeve means cooperating to engage when said mandrel is moved upward and thereafter releasable when a predetermined upward force is exerted on said mandrel to force disconnection of said first boss collet means and said first one-way acting collet sleeve means to cause said shoulder means on said housing mandrel to strike and deliver a jar to the well string in an upward direction; and i. said second boss collet means and said second one-way acting collet sleeve means cooperating to engage when said mandrel is moved downward and thereafter releasable when a predetermined downward force is exerted on said mandrel to force disconnection of said second boss collet means and said second one-way acting collet sleeve means to cause said shoulder means on said housing and mandrel to strike and deliver a jar to the well string in a downward direction.

2. The invention of claim 1 wherein said first and second one-way acting sleeve collet means includes:

a. a hollow tubular body;

b. said body having circumferentially spaced slots extending longitudinally from at least one end of said body and terminating in spaced relation relative to the other end of said body; and c. a plurality of annular ridges extending inwardly on said tubular body, said annular ridges being positioned in unequal, longitudinally spaced increments relative to each other on said tubular body.

3. The invention of claim 2 wherein said first and second boss collet means includes:

a. an annular body;

b. a plurality of annular ridges extending outwardly on said annular body, said annular ridges being arranged in unequal, longitudinally spaced increments relative to each other on said annular body whereby as said boss collet means is moved into engagement with said one-way acting sleeve means, only one of said annular ridges on said annular body contacts and moves over one of said annular ridges on said tubular body until said boss collet means and one-way sleeve acting means are fully engaged whereupon each of said annular ridges on said annular body is engaged with one of said annular ridges on said tubular body.

4. The invention of claim 3 including adjustable means carried by said housing to set the force necessary to be exerted on said mandrel to effect a jar on the well string in an upward and downward direction.

5. The invention of claim 3 including adjustment means to position said first and second one-way acting sleeve collet means whereby the force necessary to move said boss collet means through said one-way acting sleeve collet means to effect a jar on the well string may be varied.

6. The invention of claim 1 including means on said mandrel and housing for connecting the jar in a well string.

7. The invention of claim 1 including spaced seal means between said mandrel and housing to seal off the interior of said housing from the exterior as said mandrel is moved longitudinally relative to said housing.

8. The invention of claim 1 wherein said means connecting said mandrel and housing includes a plurality of circumferentially spaced, longitudinally extending recesses on said housing and projection means between said mandrel and housing and fitting in said recesses.

9. The invention of claim 1 wherein said first and second boss collet means and said first and second one-way acting sleeve collet means are constructed and arranged to be disengaged without delivering an upward or downward jar to the well string.

10. The invention of claim 1 including means to equalize the pressure externally of said housing with the pressure in the jar between said outer housing and mandrel.

11. The invention of claim 10 wherein said means to equalize includes piston means sealably engaging said housing and surrounding said mandrel, said housing having port means therein for communicating pressure exteriorly of said housing to act on said piston means.

12. The invention of claim 1 including spaced seal means between said mandrel and housing to seal off said first and second one-way acting sleeve collet means and said boss collet means from the exterior of said housing as said mandrel is moved longitudinally relative to said housing.

13. The invention of claim 12 wherein said spaced seal means defines a fluid receiving chamber therebetween and means to equalize the pressure within the chamber with the pressure externally of said housing.

14. The invention of claim 13 wherein said means to equalize includes piston means sealably engaging said housing and surrounding said mandrel, said housing having port means therein for communicating pressure exteriorly of said housing to act on said piston means.

15. The invention of claim 1 including:

a. spaced seal means to seal off said first and second one-way acting sleeve collet means and said boss collet means from the exterior of said housing as said mandrel is moved longitudinally relative to said housing; and b. additional spaced seal means between said mandrel and housing to seal off said connecting means between said mandrel and housing from the exterior of said housing as said mandrel is moved longitudinally relative to said housing.

16. The invention of claim 15 wherein said additional spaced seal means defines a fluid receiving chamber and said additional seal means includes a movable barrier sealably engaging said mandrel and housing with said housing including port means therein for communicating pressure exteriorly of said housing to act on said movable barrier in response to changes in volume of said fluid receiving chamber as said mandrel is moved longitudinally relative to said housing.

17. The invention of claim 1 including spaced seal means between said mandrel and housing to form a fluid receiving chamber therebetween for receiving said connecting means and said first and second one-way acting and boss collet means therein.

18. The invention of claim 17 wherein at least one of said seal means forms a movable barrier responsive to the fluid pressure in said mandrel.

19. In a mechanical jar for connection in a well string having an outer housing with a mandrel longitudinally, but nonrotatably movable relative to the housing whereby a predetermined force may be applied to the mandrel to deliver the jar, the invention comprising:

a. means on the mandrel engagable upon movement of the mandrel relative to the housing in either direction for locking the mandrel and housing together; said means disengaging upon continued movement of the mandrel in the same direction that locked the mandrel and housing together for imparting a jar to the well string; and b. said means being constructed and arranged so that said means is fully engaged by a predetermined force on the mandrel prior to disengagement to deliver a predetermined jar to the well string, said means including:

1. spaced sleeve means on the housing;
2. spaced annular body means on the mandrel;
3. annular ridges on said sleeve means arranged in unequal, longitudinally spaced increments therein; and
4. annular ridges on said body means arranged in unequal, longitudinally spaced increments whereby as the mandrel moves one of said body means into one of said sleeve means to engage therewith for imparting a jar, only one of said ridges on said body means engages and moves over one of said ridges on said sleeve means until said body means is telescoped in said sleeve means whereupon each of said ridges on said sleeve means is engaged with a corresponding annular ridge on said body means to thereby inhibit premature release of the mandrel and housing until the predetermined force is applied to the mandrel.

* * * * *

UNITED STATES PATENT OFFICE

CERTIFICATE OF CORRECTION

Patent No. 3,963,081 Dated June 15, 1976

Inventor(s) Edwin A. Anderson and Derrel D. Webb

It is certified that error appears in the above-identified patent and that said Letters Patent are hereby corrected as shown below:

Col. 3, line 2, after "selectively" insert --delivering--

Col. 8, line 50, change "shouler" to --shoulder--

Col. 11, line 34, after "housing" insert --and--

Signed and Sealed this

Thirty-first Day of August 1976

[SEAL]

*Attest:*

RUTH C. MASON
*Attesting Officer*

C. MARSHALL DANN
*Commissioner of Patents and Trademarks*